US007123735B2

(12) United States Patent
Ryan et al.

(10) Patent No.: US 7,123,735 B2
(45) Date of Patent: Oct. 17, 2006

(54) METHOD AND APPARATUS TO INCREASE ACOUSTIC SEPARATION

(75) Inventors: James G. Ryan, Gloucester (CA); Michael R. Stinson, Gloucester (CA)

(73) Assignee: National Research Council of Canada, Ottawa (CA)

( * ) Notice: Subject to any disclaimer, the term of this patent is extended or adjusted under 35 U.S.C. 154(b) by 884 days.

(21) Appl. No.: 09/949,832

(22) Filed: Sep. 12, 2001

(65) Prior Publication Data

US 2002/0044645 A1 Apr. 18, 2002

Related U.S. Application Data

(60) Provisional application No. 60/232,623, filed on Sep. 14, 2000.

(51) Int. Cl.
*H04R 1/20* (2006.01)
*H04R 1/02* (2006.01)
*E04B 1/82* (2006.01)

(52) U.S. Cl. ..... 381/346; 381/352; 381/354; 379/432; 181/290

(58) Field of Classification Search ..... 381/345, 381/346–354; 379/433.01–433.03, 420, 379/428, 433.1, 432, 434, 436; 73/589; 181/264, 181/268, 271–2, 284, 286, 290
See application file for complete search history.

(56) References Cited

U.S. PATENT DOCUMENTS 3,831,710 A * 8/1974 Wirt ..... 181/286

(Continued)

FOREIGN PATENT DOCUMENTS

| | | |
|---|---|---|
| CA | 2292357 | 6/2000 |
| CA | 2328265 | 6/2001 |

OTHER PUBLICATIONS

"Experiments on surface waves over a model impedence plane using acoustical pulses", Gillies A. Daigle et al., J. Acoust. Soc. Am. , 99 (4), Apr. 1996, pp. 1993-2005.

(Continued)

*Primary Examiner*—Xu Mei
(74) *Attorney, Agent, or Firm*—Marks & Clerk; Richard J. Mitchell

(57) ABSTRACT

A method and apparatus for reducing the acoustic coupling between a sound receiving transducer and a sound transmitting transducer is disclosed. A housing, wherein the receiving transducer and the transmitting transducer are mounted, is provided to increase the acoustic separation between the receiving transducer and the transmitting transducer. The housing has a surface, which may have an acoustic impedance condition, which is preferably resistive. The housing may further act as a barrier structure between the receiving transducer and the transmitting transducer.

53 Claims, 9 Drawing Sheets

U.S. PATENT DOCUMENTS

| | | | | | |
|---|---|---|---|---|---|
| 3,992,586 | A | | 11/1976 | Jaffe | 179/1 |
| 4,078,155 | A | * | 3/1978 | Botros et al. | 379/369 |
| 4,237,339 | A | | 12/1980 | Bunting et al. | 179/1 |
| 4,339,018 | A | * | 7/1982 | Warnaka | 181/286 |
| 4,378,468 | A | | 3/1983 | Braun | 179/1 |
| 4,811,402 | A | * | 3/1989 | Ward | 381/322 |
| 5,121,426 | A | | 6/1992 | Baumhauer, Jr. et al. | 379/388 |
| 5,452,265 | A | | 9/1995 | Corsaro | 367/152 |
| 5,896,461 | A | | 4/1999 | Faraci et al. | 381/386 |
| 6,016,346 | A | * | 1/2000 | Rittmueller et al. | 379/420.02 |
| 6,041,125 | A | | 3/2000 | Nishimura et al. | 381/71.4 |
| 6,085,865 | A | * | 7/2000 | Delverdier et al. | 181/292 |
| 6,290,022 | B1 | * | 9/2001 | Wolf et al. | 181/292 |
| 6,374,120 | B1 | * | 4/2002 | Krauss | 455/550.1 |
| 6,491,134 | B1 | * | 12/2002 | Ryan et al. | 181/295 |

OTHER PUBLICATIONS

"A new hybrid passive/active noise absorption system", Beyene et al., J. Acoust. Soc. Am.,101(3), Mar. 1997, pp. 1512-1515.

"Wirkungsweise und auslegungshinweise fur verbund-platten-resonatoren", H.V. Fuchs & X. Zha., Zeitschrift Fur Larmbekamp 43 (1996).

* cited by examiner

METHOD AND APPARATUS TO INCREASE ACOUSTIC SEPARATION

CROSS-REFERENCE TO RELATED APPLICATION

This application claims the benefit of U.S. Provisional Application No. 60/232,623 filed Sep. 14, 2000, incorporated by reference herein.

FIELD OF THE INVENTION

The present invention relates to the field of acoustics, and more specifically, a method and apparatus to increase acoustic separation between a sound receiving transducer (such as a microphone) and a sound transmitting transducer (such as a loudspeaker).

BACKGROUND OF THE INVENTION

In many applications it is necessary to have simultaneous transmission and reception of acoustic signals in the same frequency bands. This occurs frequently in applications involving hands-free communications where speech from a near-end talker must be acquired through a sound receiving transducer (such as a microphone) at the same time that speech from a far-end talker must be played back through a sound transmitting transducer (such as a loudspeaker).

A significant problem in the design of such systems is that the microphone intended only for near-end speech also picks up the far-end speech signal, played back using a loudspeaker. This acoustic and vibratory coupling problem manifests itself in two ways. First, if the far-end of the communications link also has some amount of coupling (acoustic or electrical), then the potential for instability or howling exists. Second, when the unintentionally acquired far-end signal is transmitted back to the far-end party, it is received as an audible echo. This echo, when delayed by propagation through the communications network, can be extremely annoying and in severe circumstances, can render the communications channel useless. The acoustic coupling problem is particularly acute when the loudspeaker and microphone are located in close proximity as in the case of a desktop handsfree telephone.

For ideal full-duplex operation in a loudspeaking telephone (i.e., simultaneous conversation in two directions), both parties in a telephone conversation must be permitted to speak and be heard simultaneously. This requires significant acoustic separation of the loudspeaker and microphone.

There are some general approaches that can reduce the coupling. The physical separation between loudspeaker and microphones should be as great as possible. Transducers can be mounted with an acoustically opaque structure inserted in the space between them. The loudspeaker should be oriented so that its maximal radiation (at high frequencies) is directed away from the microphones. If directional microphones are used, the nulls of the microphones can be directed toward the loudspeaker. Echo-cancellation techniques can be implemented in the electronics. A practical design usually employs more than one of these techniques to achieve full duplex operation.

Commonly, acoustic separation is increased in a simple way by increasing the distance between the loudspeaker and microphone. One such example of this is described in U.S. Pat. No. 4,378,468 issued Mar. 29, 1983 in the name of Daryl P. Braun (the Braun patent). The Braun patent describes an audio conference system that alleviates soundcoupled feedback by mounting the loudspeakers below the conference table ("preferably at floor level" according to the patent) while mounting the microphones above the table. While this approach does reduce acoustic coupling, its operation relies on the presence of a suitable table and it is not applicable to systems where the loudspeaker and microphone must, of necessity, be located in the same housing.

For a fixed and compact system size and when the loudspeaker and microphone are in the same housing, the effective distance between transducers can be increased by exploiting acoustic diffraction. Sound tends not to propagate around obstacles, corners or edges (hence, the utility of roadside noise barriers). The obstacles create "acoustical shadows". The residual sound that does get around an obstacle does so through the mechanism of diffraction. The effects of diffraction can be predicted numerically using finite element or boundary element techniques.

For instance, if the transducers are mounted on opposite sides of an acoustically opaque object, sounds propagating from the loudspeaker to the microphone must propagate around the obstacle (assuming that no flanking transmission paths exist).

An example of this approach is described in U.S. Pat. No. 4,078,155 issued Mar. 7, 1978 in the names of R. Botros et al. (the Botros patent). The Botros patent describes an audio conference terminal housing consisting of a cylindrical section on top of an inverted conical section. The loudspeaker is mounted at the top of the cylinder while the microphone is mounted at the bottom of the inverted conical section to provide physical separation between the speaker and microphone.

Another approach involves the use of transducers with direction-dependent characteristics: loudspeakers, microphones or both. For example, acoustic coupling is reduced by mounting a directional microphone such that the direction of minimum sensitivity coincides with the direction of the loudspeaker.

Many examples of this design approach can be found. U.S. Pat. No. 3,992,586 issued Nov. 16, 1976 in the name of Christopher Jaffe generates a directional loudspeaker pattern by driving two omni-directional loudspeakers out of phase. By positioning the microphone in the acoustic null zone of the resulting dipole, acoustic coupling is reduced. U.S. Pat. No. 4,237,339 issued Dec. 2, 1980 in the names of Bunting et al. describes a boom on which directional microphones and a loudspeaker are rigidly mounted such the microphone nulls are directed towards the loudspeaker.

A similar approach has also been used to design compact speakerphone housings as described in U.S. Pat. No. 5,121,426 issued Jun. 9, 1992 in the names of John Baumhauer et al., U.S. Pat. No. 5,896,461 issued Apr. 20, 1999 in the names of Philip Faraci et al., and U.S. Pat. No. 6,016,346 issued Jan. 18, 2000 in the names of Stephen Rittmueller et al.

The current approaches described above have limitations. The acoustic separation achieved simply by increasing distance is not applicable to small devices. Similarly, acoustic diffraction losses are significant only when the diffracting object is an appreciable fraction of a wavelength in dimension. For the acoustic wavelengths at speech signal frequencies, this implies rather large devices. Finally, approaches involving directional transducers place restrictions on the placement of these transducers which is unacceptable in some instances.

Therefore, a method and apparatus for decreasing the acoustic coupling between a sound receiving transducer (such as a microphone) and a sound transmitting transducer (such as a loudspeaker), particularly when such transducers are mounted in close proximity or in the same physical housing as occurs in the design of hands-free telephones, is needed.

SUMMARY OF THE INVENTION

A method and apparatus for increasing the acoustic separation between sound receiving transducers and sound transmitting transducers, and in particular, loudspeakers and microphones in a handsfree speakerphone, is disclosed. This is achieved by modifying the acoustic impedance on the surface of the housing between transducers. If the shape of the speakerphone provides a separation or barrier structure between the receiving and transmitting transmitters to achieve acoustic decoupling through diffraction, then the modification of the acoustic impedance gives additional acoustic separation.

Thus, according to one aspect, the invention provides a physical structure (edge or solid body) or housing which increases the acoustic separation between transmitting and receiving transducers mounted in the housing. In another aspect, an acoustical impedance on the surface of the housing is used, to control the acoustic propagation from the transmitting to receiving transducer. Preferably, the impedance is inductive or mass-like. In another embodiment, impedance may be resistive.

The invention can be used in conjunction with any type of microphone, directional or non-directional and with any type of loudspeaker, directional or non-directional.

Various features, refinements and options are contemplated. These include: (1) the exterior shape of the housing can take many forms; (2) different configurations of impedance conditions can be used to provide performance tailored to specific exterior shape; and (3) the use of an acoustically transparent material to cover any air-coupled surface treatments, for appearance and dust protection.

By providing a barrier structure, an acoustic loss due to diffraction is obtained When used in conjunction with optimized acoustic conditions to the housing, the effect is further enhanced. Since the incorporation of an acoustic condition may require no additional parts (electronic or otherwise), this approach is inexpensive.

The improved acoustic separation offered by the invention is useful in all application areas that employ simultaneous operation of a loudspeaker and microphone. These include hands-free telephones (conference and desktop), multimedia computer telephony terminals, interactive kiosks (such as drive-thrus), teleconferencing, and videoconferencing.

Other aspects and advantages of embodiments of the invention will be readily apparent to those ordinarily skilled in the art upon a review of the following description.

BRIEF DESCRIPTION OF THE DRAWINGS

Embodiments of the invention will now be described in conjunction with the accompanying drawings, wherein.

This invention will now be described in detail with respect to certain specific representative embodiments thereof, the materials, apparatus and process steps being understood as examples that are intended to be illustrative only. In particular, the invention is not intended to be limited to the methods, materials, conditions, process parameters, apparatus and the like specifically recited herein.

DETAILED DESCRIPTION OF THE PREFERRED EMBODIMENTS

Disclosed is a method and apparatus for increased acoustic separation in an acoustic apparatus.

Figure 1:
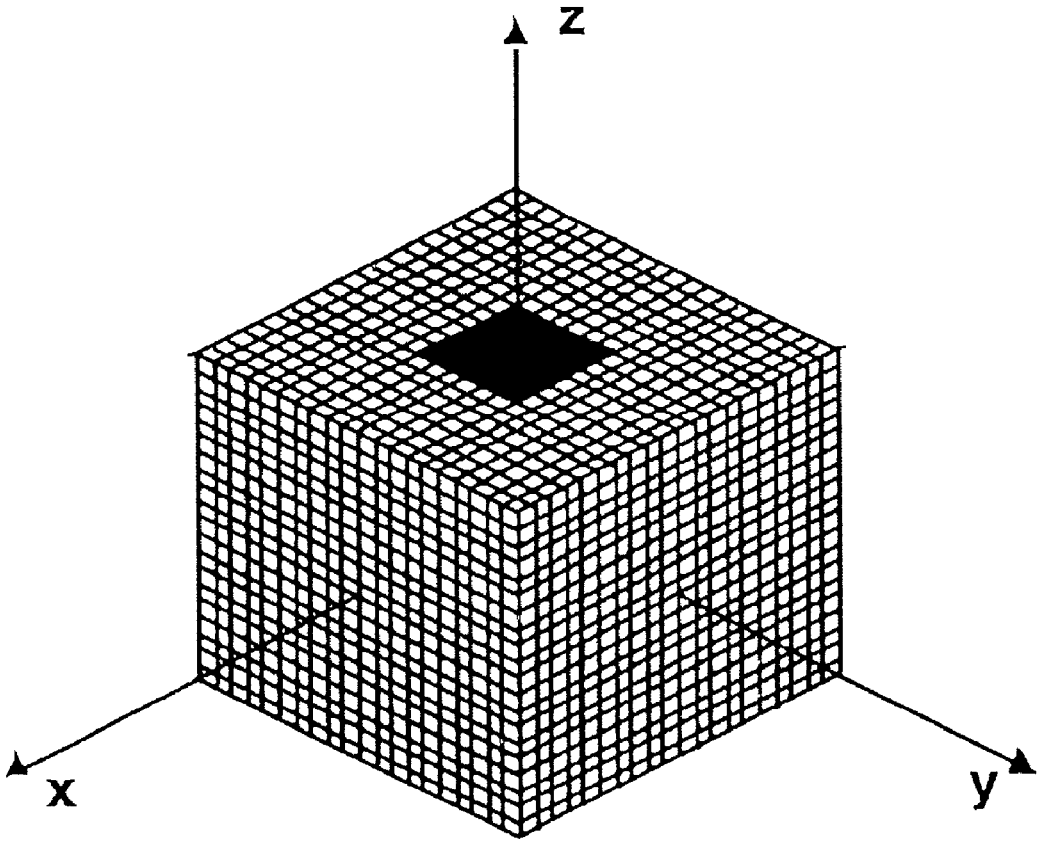
FIG. 1 illustrates a test case speakerphone used to evaluate acoustic diffraction for reducing coupling between loudspeaker-microphone coupling.

A simple test case, illustrated in FIG. 1, has been used to demonstrate the benefits of acoustical shadowing. The speakerphone housing (acting as a barrier structure) is represented by a 20 cm cube with a 6 cm square piston (representing the loudspeaker) on its top surface. Initially, acoustically-rigid surfaces (ie: surfaces with infinite acoustic impedance) are assumed.

The barrier structure serves as an acoustic surface configured to enhance diffraction loss of acoustic waves propagating by diffraction between the loudspeaker and microphone.

Figure 2:
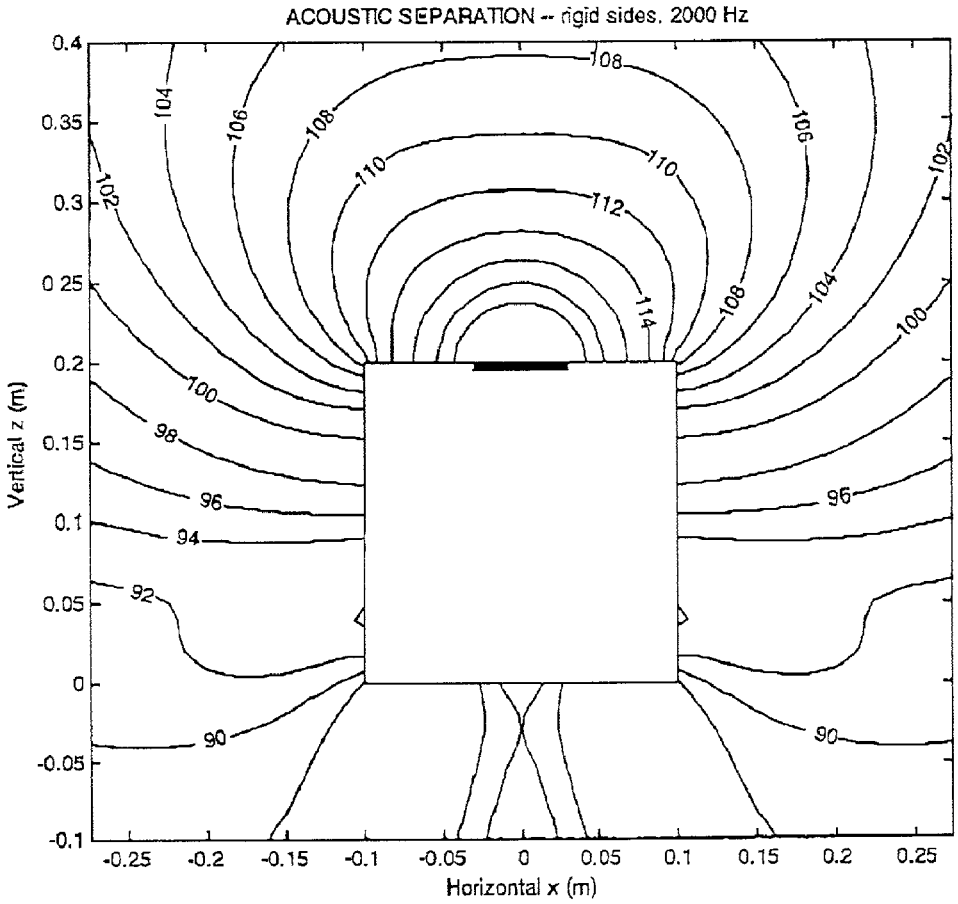
FIG. 2 shows the calculated sound field about the cubic speakerphone of FIG. 1 at the y=0 slice at a frequency of 2000 Hz.

The sound field generated by the piston was calculated using a boundary element technique. The surfaces are meshed using 1 cm square elements, giving a total of 2400 elements. The piston velocity was fixed (representing the loudspeaker vibration), at an amplitude of 1 m/s. The sound pressure level (in dB) was obtained for all points exterior to and on the surface of the speakerphone FIG. 2 shows the computed sound field at a signal frequency of 2000 Hz emitted by the loudspeaker. Contours are labeled with actual sound pressure levels (SPLs) in dB appropriate to a piston amplitude of 1 m/s. Contours of equal SPL are shown for the y=0 slice through the speakerphone. The SPLs on the sides (ie: the signal received by the microphone) are reduced by over 10 dB compared to SPLs above the loudspeaker at comparable distances. The decrease in level with distance from the piston is evident. There is a more rapid decrease, though, down the sides of the cube due to acoustic shadowing. For example, halfway down the side, a microphone measures a level of 95 dB; at the same distance but above the loudspeaker a level of about 109 dB is measured. The acoustic shadowing afforded by the shape of the speakerphone gives over 10 dB of decoupling between loudspeaker and microphone.

Figure 3:
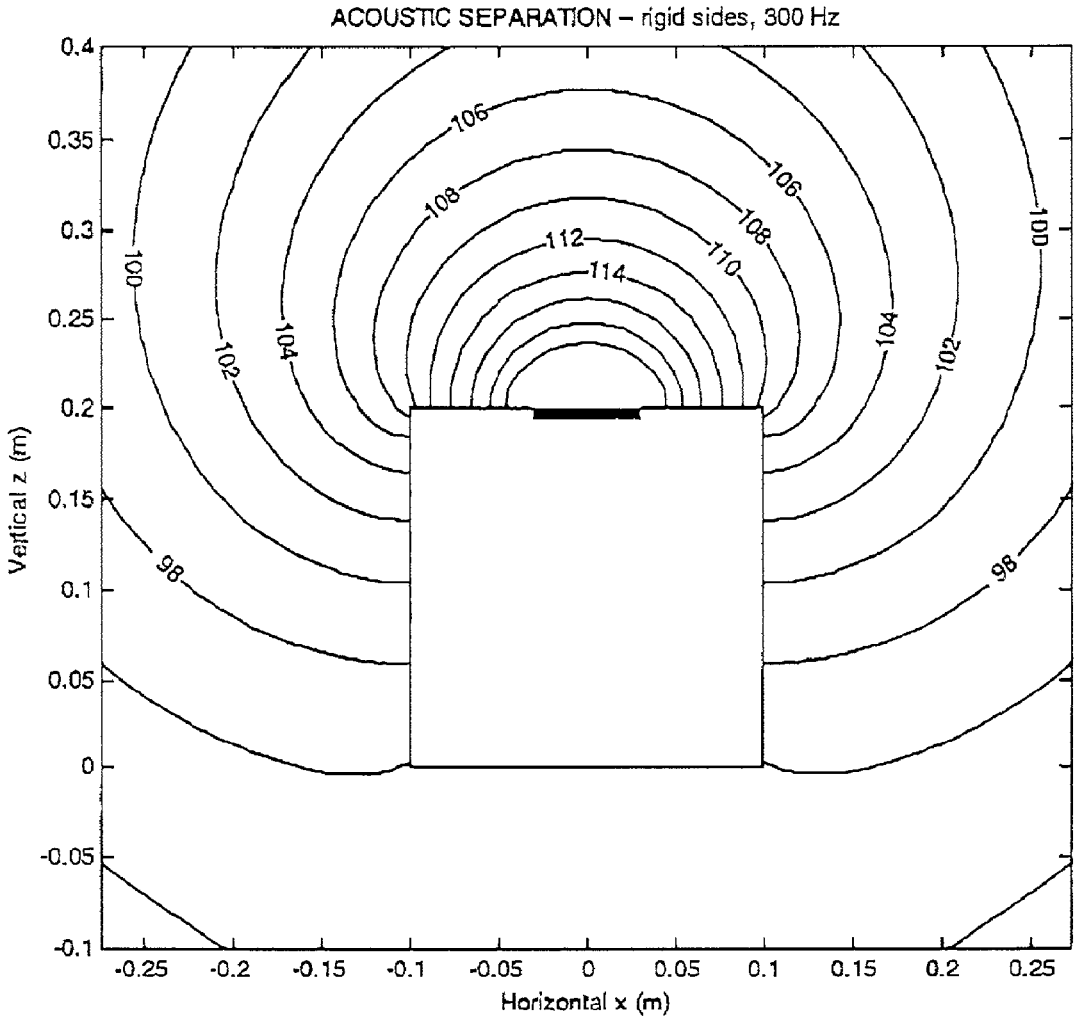
FIG. 3 shows the calculated sound field about the cubic "speakerphone" of FIG. 1 at the y=0 slice at a frequency of 300 Hz.

A similar calculation is shown in FIG. 3 for a frequency of 300 Hz. The size of the speakerphone is not as large, relative to a wavelength, as for the 2000 Hz case, and the shadowing is hence not so great. Contours are labeled with actual SPLs (dB) appropriate to a piston amplitude of 1 m/s.

The loudspeaker-microphone decoupling (levels on the sides) are reduced by about 5 dB compared to levels above the loudspeaker at comparable distances.

Figure 4:
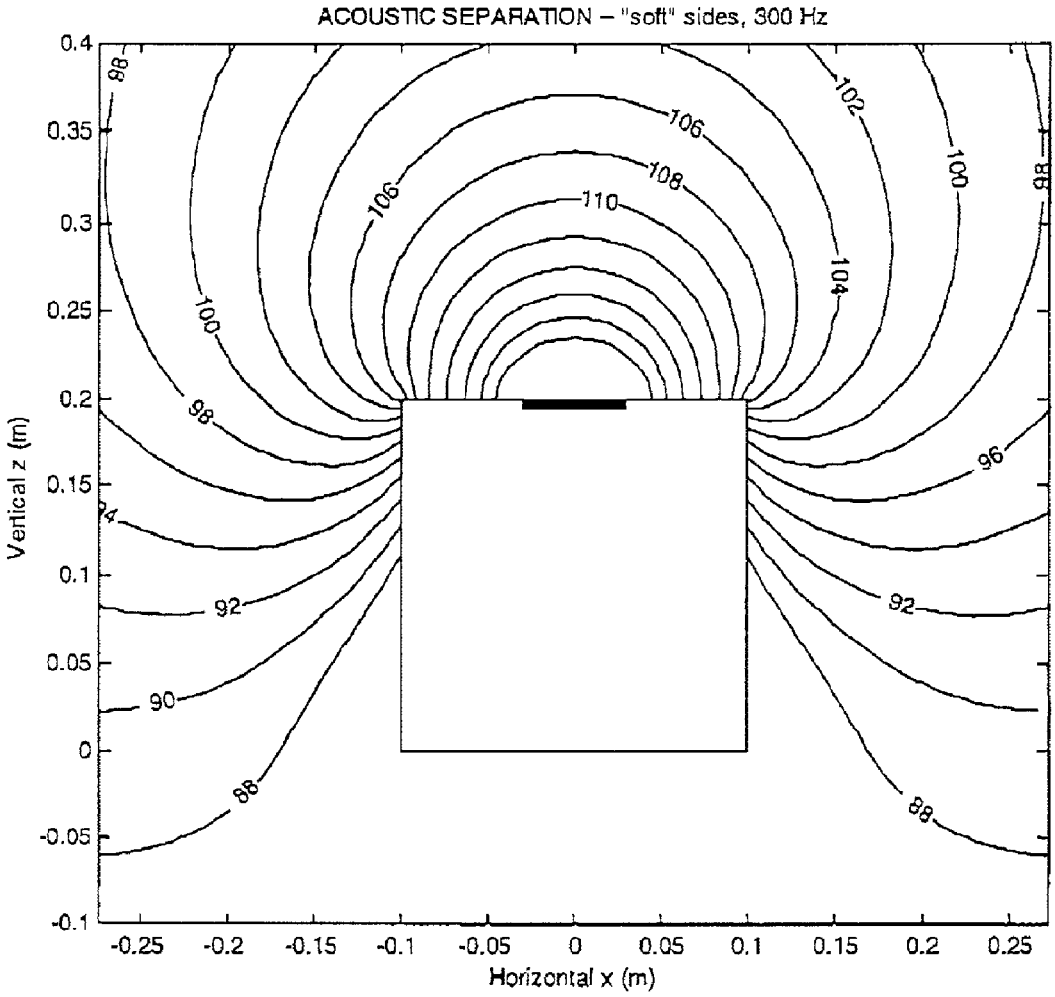
FIG. 4 shows the calculated sound field about the cubic "speakerphone" of FIG. 1 having a controlled surface impedance on the sides at a frequency of 300 Hz.

The acoustic separation between the loudspeaker and microphone is further increased if the acoustic surface impedance of the housing is modified. The 300 Hz calculation was repeated with all boundary elements on the side walls of the cube assigned a specific impedance of (−j 104 kg $m^{-2}$ $s^{-1}$), a purely inductive load, for an assumed exp(−jωt) time convention, wherein $j=\sqrt{-1}$, and ω is the angular frequency. The results are shown in FIG. 4. Considerable reductions in the levels on the sides are achieved compared to the rigid wall case in the previous figure. The propagation of sound down the side walls is seen to be more attenuated than for the rigid side wall case.

Figure 5:
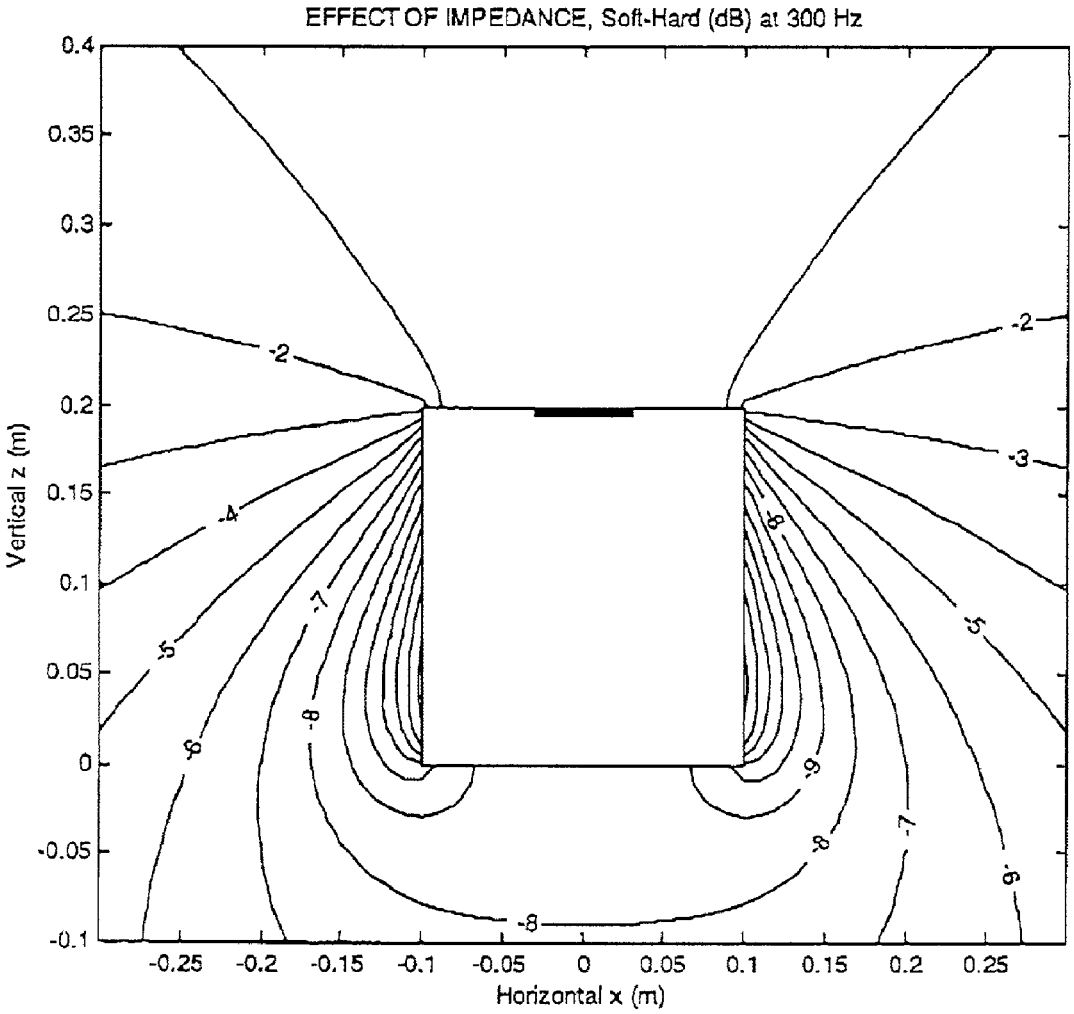
FIG. 5 shows the difference in contours between the sound fields of FIGS. 3 and 4 at a frequency of 300 Hz.

In FIG. 5, the difference in SPL between the results of FIGS. 3 and 4 is computed and displayed. This difference shows explicitly the effect of introducing a surface impedance condition. An additional acoustic separation of 10 dB is achieved between loudspeaker and microphone, over and above the separation obtained from the diffraction edge. Reductions of over 10 dB are achieved by the introduction of a surface impedance condition on the side walls. Therefore, the introduction of the surface and surface impedance on the surface results in an overall reduction of 20 dB. This is because the surface impedance discourages the propagation of acoustic energy, and when combined with the loss due to a diffractive object, the acoustic separation is enhanced.

Methods of constructing surface impedance conditions are contemplated. One possibility is to make use of a celled, "soda-straw" construction For the example shown, cells having a depth of 33 cm would be required. This would be awkward to achieve in the present 20 cm cube, but possible if folded or coiled cells are used. Furthermore, the changing impedance of such cells with frequency leads to changes in acoustic separation, as detailed below.

The acoustic surface impedance Z relates the sound pressure p at a surface to the component of velocity normal to the surface $v_y$, as:

$$p=-Zv_y; \tag{1}$$

wherein y is directed out of the surface. The velocity may be related to the gradient in sound pressure:

$$v_y=\frac{1}{j\rho\omega}\frac{dp}{dy}; \tag{2}$$

wherein ω is the angular frequency, p is the air density, $j=\sqrt{-1}$, and an exp (−jωt) time dependence has been assumed. Thus, the boundary condition may be written as $$\left[\frac{dp}{dy}+\frac{j\rho\omega}{Z}p\right]_{y=0}=0. \tag{3}$$

Figure 6:
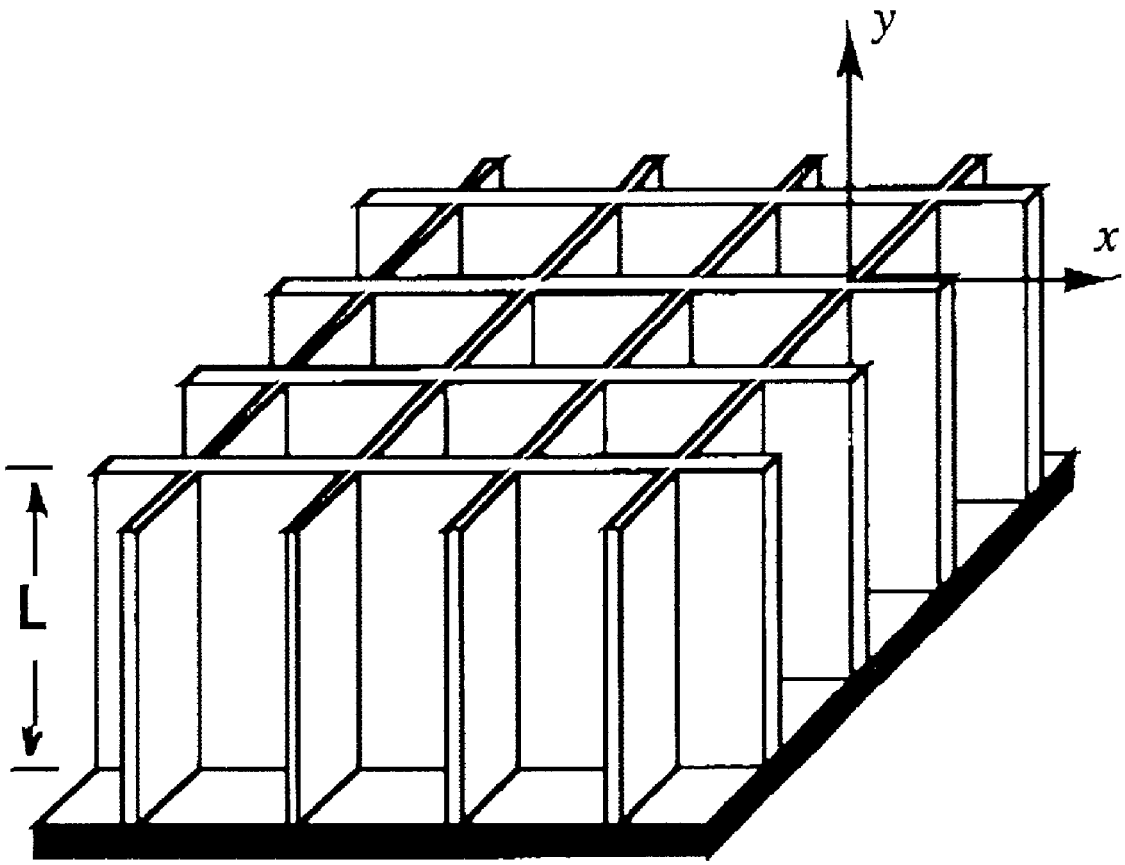
FIG. 6 illustrates a generic celled structure providing variable acoustic impedance.

Referring to FIG. 6, a prototypal structure with a plurality of adjacent cells providing variable acoustic impedance is contemplated. Provided that the lateral dimensions of each cell (i.e., normal to the y axis shown in the Figure) are small compared to the acoustic wavelengths being used, the effects of the structure can be described in terms of an effective acoustic surface impedance given by:

$$Z=jpc\cot kL; \tag{4}$$

wherein c is the speed of sound; k=ω/c is the wave number; and L is cell depth. This impedance is purely reactive and has a resonant structure controlled by the cell depth. The impedance is plotted in, FIG. 7, for a cell depth of 10 cm. Up to the first resonance (at 857.5 Hz), the surface is acoustically compliant or "spring-like". It is known that surface waves can arise in this frequency range (see for example G. A. Daigle, M. R. Stinson, and D. I. Havelock (1996). "Experiments on surface waves over a model impedance plane using acoustical pulses", J. Acoust. Soc. Am. 99, 1993–2005, which is incorporated herein by reference). Between 857.5 Hz and 1715 Hz, the surface is inertive or "mass-like". As frequency increases further, the impedance cycles between these two regimes.

Figure 8:
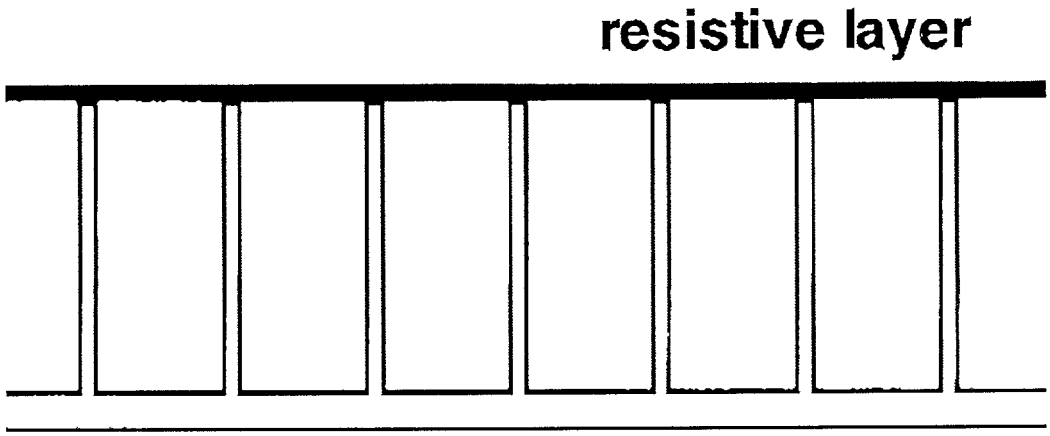
FIG. 8 illustrates the side view of a simple celled structure with an overlying resistive layer.

Adding some resistive damping to this system proves useful. It can be introduced using, for example, a thin layer of a porous material (such as felt, fabric, open-cell foams, or a grid with small holes), as illustrated in FIG. 8. For a flow resistivity σ, a layer of thickness λ gives an acoustic resistance of approximately:

$$R=pc\sigma\lambda. \tag{5}$$

The surface impedance for this system is:

$$Z=pc\sigma\lambda+jpc\cot kL. \tag{6}$$

Using thicker layers of porous materials or materials with higher flow resistivity, a surface impedance that is essentially resistive can be created.

More complicated structures can be used to tailor the frequency dependence of Z for specific applications. Different impedance functions might be desirable on different sections of a speakerphone surface. Broadband increases in acoustic separation of 10 to 20 dB are achievable for various surface impedance conditions.

Cellular structures represent one approach to constructing impedance surfaces and are not intended to limit this invention. Any structure that provides the appropriate surface impedance will do. The determination of the appropriate acoustic surface impedance is governed by several factors, including the frequency range of operation, the shape of the speakerphone housing, the location of the microphone and loudspeaker in the housing, the presence of neighbouring objects (e.g., table) that scatter sound, and the availability of options for constructing surface impedance conditions. Except for the simplest of examples, numerical calculations are performed to determine the sound field around the object due to the loudspeaker for a given choice of acoustic surface impedance and distribution of impedance over the surface Finite-element or boundary-element techniques could be applied, for example. The response at the microphone position is determined as a function of sound frequency for different choices of acoustic surface impedance on the object. The choices that give the lowest overall response are the optimal choices. These distributions and values of surface impedance are the target impedances that a practical implementation will try to match.

Figure 7:
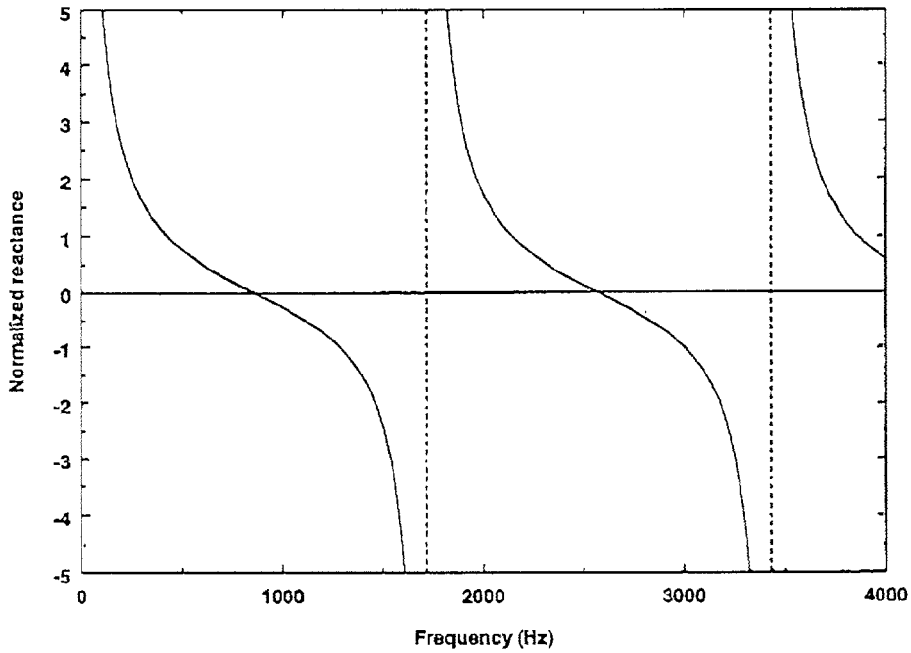
FIG. 7 illustrates the acoustic surface resistance for a simple celled structure having a cell depth of 10 cm.

The structures of FIGS. 6 and 7 illustrate the use of celled structures to construct impedance conditions. More complicated arrangements of chambers and multiple layers can be used to obtain different acoustic surface impedances. Some examples of alternate cell geometries and distributions are disclosed in Canadian patent application 2,328,265. A compound baffle resonator is described in H. V. Fuchs and X. Zha (1995), Zeitschrift Fur Larmbekampfung, Vol. 43, 1–8. Daigle et al. describes a calculation of surface impedance for a celled structure with acoustical leakage through the cell walls. All three references are incorporated herein by reference.

Surface impedance can also be introduced by active methods whereby impedance is controlled using loudspeakers and specialized electronic controls. U.S. Pat. No. 6,041,125 issued Mar. 21, 2000 in the name of Nishimura et al., describes the use of sound pressure detectors, oscillation plates, and a signal processing unit to achieve a acoustic impedance. U.S. Pat. No. 5,452,265 issued Sep. 19, 1995 in the name of Corsaro, describes the use of transducers to receive and transmit sound in the hull of a submarine to reduce sonar echoes, effectively creating an impedance as close to the characteristic impedance of water as possible. Another method of modifying a surface's impedance is disclosed in S. Beyene and R. Burdisso (1997). "New hybrid passive/active noise absorption system", J. Acoust. Soc. Am 101, 1512–1516. All three references are incorporated herein by reference.

The barrier structure (or speakerphone housing) can be of virtually any shape, limited mostly by constraints of its specific application. To achieve as much acoustic separation as possible, the shape should be chosen to provide as much diffractive loss as possible between the loudspeaker and microphone positions. Practically, this means placing as large an obstruction as possible between the loudspeaker and microphone. Some geometric possibilities have been listed in Canadian patent application 2,292,357, incorporated herein by reference. Although this patent application addresses the different goal of improved microphone array performance, the geometries given in FIGS. 7A to 24B introduce diffractive loss, assuming a loudspeaker placement on the top of the objects. It is recognized that for some applications, the portion of housing between loudspeaker and microphone may be flat, so there would be no diffractive loss.

Further increases in the acoustic separation between the loudspeaker and microphone, in addition to the diffractive loss, can be obtained by introducing non-rigid impedances on the diffractive surface. The impedance is optimized for the particular shape of diffractive surface used. The values of the acoustic surface impedance used and the location of the regions of non-rigid impedance determine the effective increase in acoustic separation.

Figure 9:
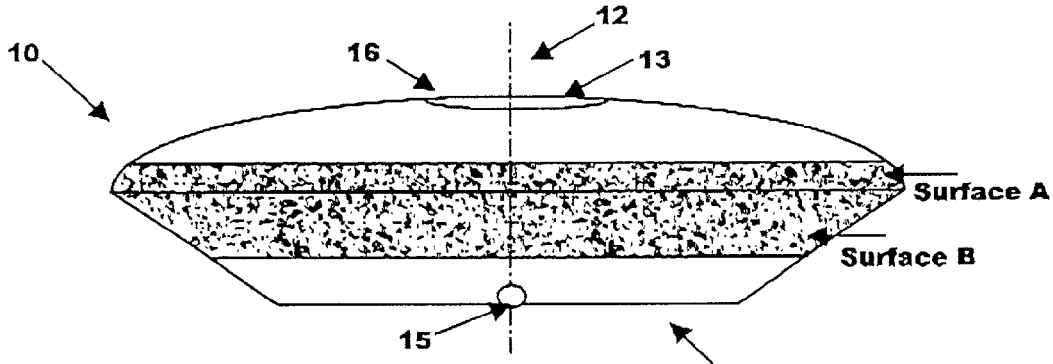
FIG. 9 illustrates a side view of a speakerphone that exploits both diffraction and acoustic surface impedance, for enhanced separation of microphone from loudspeaker.

An example of a speakerphone design that can exploit the effects of both diffraction and acoustic surface impedance is shown in FIG. 9. The housing 10 is symmetric about vertical axis 12. The bottom portion 14 has the shape of an inverted cone and the top portion 16 has a section of a sphere. A loudspeaker 13 is located at the top of the housing and microphone 15 is located near the base (because of symmetry, only one microphone needs to be considered here). The surfaces in between (top and side) can have impedance conditions incorporated to enhance the acoustic separation. In the example to be discussed, the housing has a maximum diameter of 240 mm and a base diameter of 100 mm. The height to the interface between top and side is 60 mm and the overall height is 90 mm. The loudspeaker has a diameter of 60 mm; the microphone is at a height of 8.6 mm.

Various acoustic impedance conditions can be applied to the top and side surfaces. In this case, impedance conditions were applied to two surface regions, indicated on FIG. 9 as first surface A and second surface B. Surface A extends from the top/side edge roughly halfway to the top of the housing, between heights of 60 mm and 80.3 mm. Surface B extends from the top/side edge downward, between heights of 17.2 mm and 60 mm.

The acoustic separation was evaluated using a boundary element calculation technique. The loudspeaker was assumed to have a piston-like motion with a velocity amplitude of 1 m/s. The speakerphone is assumed to sit on an infinite, acoustically-hard table. The resulting sound field, subject to various surface impedance boundary conditions, was evaluated for sound frequencies between 200 Hz and 3600 Hz. The sound pressure level at the microphone is a measure of the acoustic coupling between loudspeaker and microphone. The effect of various impedance treatments is demonstrated by comparison to the rigid surface condition (for which all surfaces are acoustically rigid, i. e., infinite impedance, zero admittance).

Figure 10:
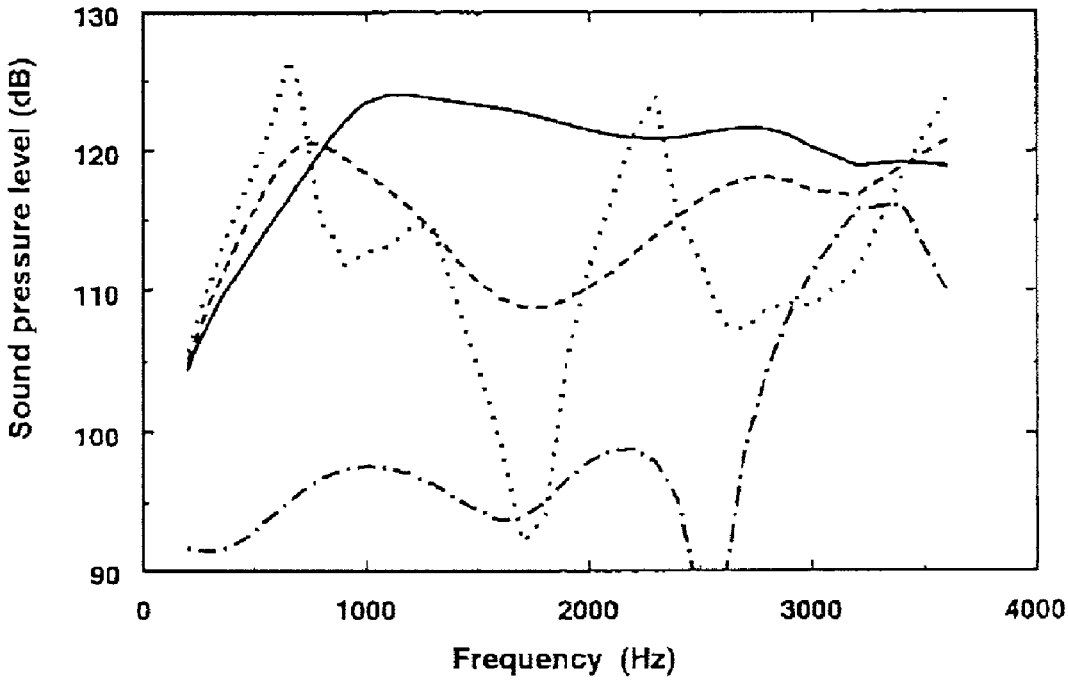
FIG. 10 illustrates the sound pressure level at the microphone, for constant loudspeaker amplitude, for various surface impedance treatments.

Results of the sound pressure level (SPL) at the microphone position, for constant velocity of the piston representing the loudspeaker, are presented in FIG. 10. The solid curve represents the results for acoustically rigid surfaces and is the baseline for comparision. The dash-dotted line represents results for a simple resistive layer, with no celled structure, having a surface resistance of 0.1 pc on surface B. Over 20 dB of increased acoustic separation is obtained between 500 Hz and 2700 Hz. This surface impedance condition, however, would be difficult to achieve.

A practical implementation using 5 cm cells and a resistive layer of 0.5 pc for surface B is represented in FIG. 10 as the dashed line. Over 10 dB of increased separation is found for a broad range of frequencies. Another embodiment is represented by the dotted line, wherein 10 cm cells on surface A and 5 cm cells on surface B both have a 0.1 pc resistive layer. Broadband increases in the acoustic separation are evident in different frequency regimes.

Another embodiment may make use of an acoustically transparent material to cover any air-coupled surface treatments, for appearance and dust protection.

It has been shown that improvements in acoustic separation are obtained for impedances that are inductive ("mass-like"), with further improvements where resisitance is added. Impedances that are compliant ("spring-like") tend to permit the formation of air-coupled surface waves that can reduce the desired effect (e.g., the dashed and dotted curves on FIG. 10 show elevated sound pressure levels at frequencies near 600 Hz because of this effect). The presence of a resistive component in Z will damp out surface waves.

It has been shown that different applications will present different constraints; the frequency responses of the loudspeaker and microphones will determine the range of frequency where increased acoustic loss is desirable. The size of the housing must be taken into consideration since larger housings will have much more diffractive loss at high frequencies, so the timing of the impedance is preferably geared to lower frequencies.

Clear benefit is demonstrated by these results. The acoustic separation between loudspeaker and microphone can be increased by 10–20 dB over a broad frequency range. The selection of optimum surface impedance treatment, though, must be tuned to the specific application. For example, the acoustic separation between loudspeaker and microphone, using 5 cm cells and a 0.5 pc resistive layer on surface B is over 10 dB between 1500 and 2000 Hz. Several other factors (e.g., frequency response of both microphone and loudspeaker, proximity of reflecting surfaces, acoustical noise environment) must be considered.

Note that while the examples presented here include only one omni-directional microphone, the technique is broadly applicable. Since this invention relates to the housing design, enhanced separation may also be obtained when using directional transducers or arrays of transducers (such as microphone array for sound pickup).

Numerous modifications may be made without departing from the spirit and scope of the invention as defined in the appended claims.

What is claimed is:

1. An acoustic apparatus for the simultaneous transmission and reception of acoustic signals in the same frequency band, the apparatus comprising: a transmitting transducer; a receiving transducer; and a housing, the transmitting transducer and the receiving transducer being mounted on the housing so as to be physically and acoustically separated from each other, the housing having an outer surface portion lying between said receiving transducer and said transmitting transducer, said surface portion comprising plurality of adjacent cells, each cell forming a resonant structure at a frequency propagating between the transmitting transducer and receiving transducer, whereby said plurality of cells modifies the acoustic impedance of said surface portion compared to an acoustically rigid surface so as to increase the acoustic separation between the transmitting and receiving transducers.

2. The acoustic apparatus of claim 1, wherein the cells have a depth of at least about 5 cms.

3. The acoustic apparatus of claim 2, wherein the receiving transducer is a microphone and the transmitting transducer is a loudspeaker.

4. The acoustic apparatus of claim 3, wherein the apparatus is a speakerphone.

5. The acoustic apparatus of claim 3, wherein the microphone is directional.

6. The acoustic apparatus of claim 3, wherein the microphone is non-directional.

7. The acoustic apparatus of claim 3, wherein the loudspeaker is directional.

8. The acoustic apparatus of claim 3, wherein the loudspeaker is non-directional.

9. The acoustic apparatus of claim 1, wherein the surface structure comprises different regions; and different regions of the surface structure have different impedances.

10. The acoustic apparatus of claim 1, wherein the acoustic impedance includes an acoustic impedance that is mass-like and/or that is resistive.

11. The acoustic apparatus of claim 1, wherein the housing provides a diffraction barrier between said transmitting transducer and said receiving transducer.

12. The acoustic apparatus of claim 11, wherein the barrier structure is a celled structure having at least a first region and a second region.

13. The acoustic apparatus of claim 12, further comprising an acoustically transparent material covering said surface portion.

14. The acoustic apparatus of claim 12, wherein the acoustic impedance uses cells of about 5 cm depth with a resistive layer of about 0.5 pc on the second region.

15. The acoustic apparatus of claim 12, wherein the acoustic impedance uses cells of about 10 cm depth on the first region and cells of about 5 cm depth with a resistive layer of about 0.1 pc on the second region.

16. The acoustic apparatus of claim 15, wherein the acoustic impedance uses a resistive layer of about 0.1 pc on the first region.

17. The acoustic apparatus of claim 1, wherein said plurality of cells are arranged in a uniform array and aligned side by side.

18. An acoustic apparatus for reducing the acoustic coupling between a sound receiving transducer and a sound transmitting transducer, the apparatus comprising:

a sound transmitting transducer;

a sound receiving transducer; and a housing, the sound transmitting transducer and the sound receiving transducer being mounted in the housing so as to be physically and acoustically separated from each other;

wherein the housing acts as a barrier structure for preventing direct sound propagation between the transmitting transducer and receiving transducer, the barrier having an acoustic outer surface portion lying between the sound transmitting transducer and the sound receiving transducer, said surface portion comprising plurality of adjacent cells, each cell forming a resonant structure at a frequency propagating between the transmitting transducer and receiving transducer, whereby said plurality of cells modifies the acoustic impedance of said surface portion compared to an acoustically rigid surface so as to increase the acoustic separation between said transmitting and receiving transducers.

19. The acoustic apparatus of claim 18, wherein the transmitting transducer is mounted at the top of the housing, and the sound receiving transducer is mounted to the bottom.

20. The acoustic apparatus of claim 18, wherein the transmitting transducer is mounted at the bottom of the housing, and the sound receiving transducer is mounted to the top.

21. The acoustic apparatus of claim 18, wherein the housing is symmetric about a vertical axis, comprises a bottom portion in the shape of an inverted cone, a domed cover portion on said bottom portion and defining a rim at the junction of said bottom portion and said cover portion, and wherein said plurality of cells is located in a band extending around said bottom portion adjacent said rim.

22. The acoustic apparatus of claim 18, wherein said of cells have a depth of at least 5 cms.

23. The acoustic apparatus of claim 18, wherein the acoustic surface portion comprises different regions, each region having a different impedance.

24. The acoustic apparatus of claim 18, wherein the acoustic impedance includes in acoustic impedance that is mass-like and/or that is resistive.

25. The acoustic apparatus of claim 18, wherein the barrier structure is a celled structure having a first region and a second region.

26. The acoustic apparatus of claim 25, further comprising an acoustically transparent material to cover any air-coupled surface treatments.

27. The acoustic apparatus of claim 25, wherein the acoustic impedance uses cells of about 5 cm depth with a resistive layer of about 0.5 pc on the second region.

28. The acoustic apparatus of claim 25, wherein the acoustic impedance uses cells of about 10 cm depth on the first region and cells of about 5 cm depth with a resistive layer of about 0.1 pc on the second region.

29. The acoustic apparatus of claim 28, wherein the acoustic impedance uses a resistive layer of about 0.1 pc on the first region.

30. The acoustic apparatus of claim 18 wherein the sound receiving transducer is a microphone and the sound transmitting transducer is a loudspeaker.

31. The acoustic apparatus of claim 30, wherein the acoustic apparatus is a speakerphone.

32. The acoustic apparatus of claim 30, wherein the microphone is directional.

33. The acoustic apparatus of claim 30, wherein the microphone is non-directional.

34. The acoustic apparatus of claim 30, wherein the loudspeaker is directional.

35. The acoustic apparatus of claim 30, wherein the loudspeaker is non-directional.

36. The acoustic apparatus of claim 18, wherein reductions in sound pressure levels of 10 dB to 20 dB are achieved.

37. The acoustic apparatus of claim 21, wherein said plurality of cells is also located in a second band extending around said cover portion adjacent said rim.

38. A method of reducing the acoustic coupling in an acoustic apparatus for the simultaneous transmission and reception of acoustic signals between a sound receiving transducer and a sound transmitting transducer in the same frequency band, the method comprising the steps of:

providing a housing, wherein the transmitting transducer and receiving transducer are mounted in the housing and physically and acoustically separated from each other; and configuring an outer surface portion of the housing that lies between the sound receiving transducer and the sound transmitting transducer by providing a plurality of adjacent cells, each cell forming a resonant structure at a frequency propagating between the transmitting transducer and receiving transducer, whereby said plurality of cells modifies the acoustic impedance of said surface portion compared to an acoustically rigid surface so as to increase the acoustic separation between the transmitting and receiving transducers.

39. The method of claim 38, wherein the surface portion has different regions with different impedances.

40. The method of claim 38, wherein the acoustic impedance is mass-like and/or resistive.

41. The method of claim 38, wherein the housing provides a diffraction barrier between the transmitting and receiving transducers.

42. The method of claim 41, wherein the barrier structure is a celled structure having a first region and a second region.

43. The method of claim 42, further comprising the step of using an acoustically transparent material to cover any air-coupled surface treatments.

44. The method of claim 42, further comprising the step of using an acoustic impedance with cells of about 5 cm depth with a resistive layer of about 0.5 pc on the second region.

45. The method of claim 42, further comprising the step of using an acoustic impedance with cells of about 10 cm depth on the first region and cells of about 5 cm depth with a resistive layer of about 0.1 pc on the second region.

46. The method of claim 45, further comprising the step of using an acoustic impedance of a resistive layer of about 0.1 pc on the first region.

47. The method of claim 38, wherein the sound receiving transducer is a microphone and the sound transmitting transducer is a loudspeaker.

48. The method of claim 47, wherein the apparatus is a speakerphone.

49. The method of claim 47, wherein the microphone is directional.

50. The method of claim 47, wherein the microphone is non-directional.

51. The method of claim 47, wherein the loudspeaker is directional.

52. The method of claim 47, wherein the loudspeaker is non-directional.

53. The method of claim 42, wherein reductions in sound pressure levels of 10 dB to 20 dB are achieved.

* * * * *